US010833446B2

(12) United States Patent
Miyamura et al.

(10) Patent No.: US 10,833,446 B2
(45) Date of Patent: Nov. 10, 2020

(54) COMPLEX ELECTRICAL CONNECTION DEVICE

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Tetsuya Miyamura, Mie (JP); Masaaki Tabata, Mie (JP); Yasuo Omori, Mie (JP); Hajime Matsui, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 387 days.

(21) Appl. No.: 15/779,558

(22) PCT Filed: Nov. 28, 2016

(86) PCT No.: PCT/JP2016/085154
§ 371 (c)(1),
(2) Date: May 29, 2018

(87) PCT Pub. No.: WO2017/104389
PCT Pub. Date: Jun. 22, 2017

(65) Prior Publication Data

US 2020/0303864 A1 Sep. 24, 2020

(30) Foreign Application Priority Data

Dec. 16, 2015 (JP) ..... 2015-245029

(51) Int. Cl.
*H01R 13/514* (2006.01)
*H01R 13/506* (2006.01)
(Continued)

(52) U.S. Cl.
CPC ..... *H01R 13/514* (2013.01); *H01R 13/506* (2013.01); *H01R 31/08* (2013.01); *H01R 2107/00* (2013.01)

(58) Field of Classification Search
CPC .... H01R 13/514; H01R 13/506; H01R 31/08; H01R 2107/00
See application file for complete search history.

(56) References Cited

U.S. PATENT DOCUMENTS 8,454,378 B2 * 6/2013 Osterhart ..... H01R 24/84 439/284
8,992,251 B2 * 3/2015 Smutny ..... H01R 31/08 439/595
(Continued)

FOREIGN PATENT DOCUMENTS

JP 2005-346940 12/2005
JP 2005-353361 12/2005
(Continued)

OTHER PUBLICATIONS

International Search Report dated Feb. 14, 2017.

*Primary Examiner* — Xuong M Chung Trans
(74) *Attorney, Agent, or Firm* — Gerald E. Hespos; Michael J. Porco; Matthew T. Hespos

(57) ABSTRACT

It is aimed to provide a complex electrical connection device capable of efficiently shorting and connecting wires to each other by a compact structure. The complex electrical connection device includes first and second connectors (C1, C2). The first connector (C1) includes first shorting female terminals (TS1), mutual connection female terminals (TM1) and a first connector housing (H1). The second connector (C2) includes second shorting female terminals (TS2), mutual connection male terminals (TM2), a shorting female terminal (SA) having first and second male terminal portions (31A, 32A) capable of respectively connecting the first and
(Continued)

second shorting female terminals (TS1, TS2), and a second connector housing (H2) for holding this shorting member. The second connector housing (H2) holds the mutual connection male terminals (TM2) at positions where the mutual connection terminals (TM1, TM2) are connectable to each other and holds the second shorting female terminals (TS2) at positions where the second shorting female terminals (TS2) are connected to the second male terminal portions (32A).

6 Claims, 13 Drawing Sheets

(51) Int. Cl.
*H01R 31/08* (2006.01)
*H01R 107/00* (2006.01)

(56) References Cited

U.S. PATENT DOCUMENTS

| | | | | |
|---|---|---|---|---|
| 9,922,755 | B2 * | 3/2018 | Matsui | H01R 13/4361 |
| 10,205,264 | B2 * | 2/2019 | Washio | H01R 13/506 |
| 10,290,966 | B2 * | 5/2019 | Washio | H01R 31/08 |
| 10,714,860 | B2 * | 7/2020 | Washio | B60R 16/0207 |
| 2005/0266731 | A1 | 12/2005 | Kobayashi et al. | |
| 2009/0042445 | A1 | 2/2009 | Ichio et al. | |

FOREIGN PATENT DOCUMENTS

| | | |
|---|---|---|
| JP | 2009-54473 | 3/2009 |
| JP | 2011-82027 | 4/2011 |
| JP | 2013-12437 | 1/2013 |
| JP | 2013-149501 | 8/2013 |

* cited by examiner

COMPLEX ELECTRICAL CONNECTION DEVICE

BACKGROUND

Field of the Invention

The invention relates to a complex electrical connection device having both a shorting function of shorting three or more shorting target wires to each other and a mutually connecting function of mutually connecting specific wires different from the shorting target wires one-to-one.

Description of the Related Art

A joint connector is a device for electrically connecting wires in a wiring harness of an automotive vehicle or the like and has shorting portions for shorting some of the wires to each other. For example, Japanese Unexamined Patent Publication No. 2005-353361 discloses a connector with a shorting busbar for connecting tab-like terminals to each other and a connector housing for holding the tab-like terminals and the busbar with the tab-like terminals laterally aligned.

Wires routed in an automotive vehicle or the like include wires to be connected one-to-one besides a group of wires to be shorted to each other by a joint connector, for example, as described in Japanese Unexamined Patent Publication No. 2005-353361. The wires that are to be connected one-to-one are used in a conventionally general connector. More particularly, the general connector includes male and female terminals to be connected respectively to ends of the wires to be connected to each other, a male connector housing for holding the male terminals and a female connector housing for holding the female terminals and configured to connect the wires to each other by connecting the male and female terminals. Accordingly, dedicated connectors conventionally have to be used respectively to short wires to each other and connect specific wires to each other. This becomes a major barrier in reducing the number of components and a routing space. Further, a connecting operation needs to be performed individually for each connector, leading to poor efficiency.

The invention aims to provide a complex electrical connection device enabling both the shorting of three or more wires to each other and mutual one-to-one connection of specific wires by a compact structure and an efficient operation.

SUMMARY

The invention is directed to a complex electrical connection device having both a function of shorting three or more shorting target wires to each other and a function of mutually connecting mutual connection target wires different from the shorting target wires one-to-one. This device includes a first connector, and a second connector connectable to the first connector in a specific connector connecting direction. The first connector includes first shorting female terminals having female electrical contact portions and to be mounted on ends of some of the shorting target wires. The first connector also includes mutual connection female terminals having female electrical contact portions and to be mounted on an end of one of the mutual connection target wires. The first connector also includes a first connector housing that is configured to hold the first shorting female terminals and the mutual connection female terminals in such an orientation that all of the electrical contact portions of the first shorting female terminals and the mutual connection female terminals face in the same direction. The second connector includes second shorting female terminals having female electrical contact portions and to be mounted on ends of the shorting target wires other than those on which the first shorting female terminals are to be mounted. The second connector also includes mutual connection male terminals having male electrical contact portions that can fit to the electrical contact portions of the mutual connection female terminals and to be mounted on an end of a corresponding mutual connection target wire. The device further includes a shorting member made of a conductor and configured to short the first shorting female terminals and the second shorting female terminals. The shorting member integrally includes a base, first male terminal portions projecting in a first projecting direction from the base and shaped to fit to the electrical contact portions of the first shorting female terminals and second male terminal portions projecting from the base in a second projecting direction opposite to the first projecting direction and shaped to fit to the electrical contact portions of the second shorting female terminals. The shorting member forms a shorting circuit configured to short the first shorting female terminals to be connected to the first male terminal portions and the second shorting female terminals to be connected to the second male terminal portions to each other. The second connector further has a second connector housing connectable to the first connector housing in the connector connecting direction. The second connector housing includes a housing fitting portion to be fit to the first connector housing, a shorting member holding portion configured to hold the shorting member at a position where the first shorting female terminals held in the first connector housing are connected to the first male terminal portions as the first connector housing is fit to the housing fitting portion, a male terminal holding portion configured to hold the mutual connection male terminals at positions that are deviated from the shorting member in a direction perpendicular to the connector connecting direction and where the mutual connection female terminals held in the first connector housing are connected to the mutual connection male terminals as the first connector housing is fit to the housing fitting. A female terminal holding portion is configured to hold the second shorting female terminals at positions where the second shorting female terminals are connected to the second male terminal portions.

DETAILED DESCRIPTION

FIGS. 1 to 7 show a complex electrical connection device according to the embodiment of the present invention. This complex electrical connection device has both a function of shorting three or more (eight in this embodiment) shorting target wires to each other and a mutually connecting function of mutually connecting mutual connection target wires (three pairs in this embodiment) different from the shorting target wires one-to-one.

This electrical connection device includes a first connector C1 and a second connector C2. The second connector C2 is connectable to the first connector C1 in a specific connector connecting direction, i.e. a horizontal direction in an orientation shown in each figure and connections are collectively made by this connector connection.

The first connector C1 according to this embodiment includes first shorting female terminals TS1, mutual connection female terminals TM1 and a first connector housing H1.

The first shorting female terminals TS1 are mounted respectively on ends of first shorting target wires WS1. Similarly, the mutual connection female terminals TM1 are mounted on ends of first mutual connection target wires WM1 of each pair of mutual connection target wires.

Each female terminal TS1, TM1 is made of a conductive material and has the same shape in this embodiment. Specifically, each female terminal TS1, TM1 integrally includes a female electrical contact portion 10 and a crimping portion 12 located behind the electrical contact portion 10, as shown in FIGS. 4 to 9. The crimping portion 12 includes a barrel to be crimped to embrace an exposed conductor part and an insulation coating part behind the exposed conductor part at the end of each wire WS1, WM1. The crimping portion 12 enables electrical connection between the conductor part and the female terminal TS1, TM1 by being crimped to the conductor part.

The first connector housing H1 holds the first shorting female terminals TS1 and the mutual connection female terminals TM1 in such an orientation that all the electrical contact portions of the first shorting female terminals TS1 and the mutual connection female terminals TM face in the same direction along the connector connecting direction.

Figure 10:
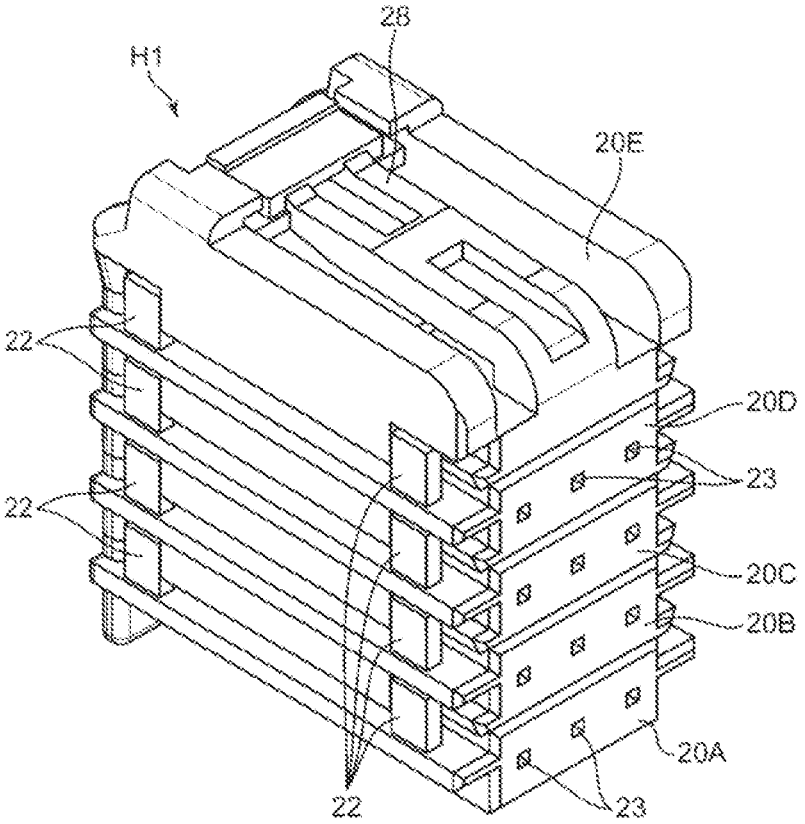
FIG. 10 is a perspective view showing a first connector housing of the electrical connection device.
Figure 11:
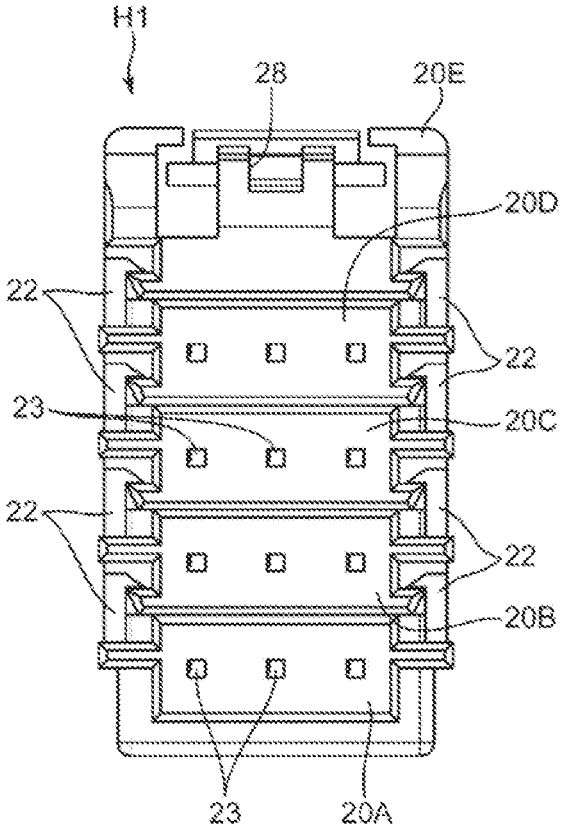
FIG. 11 is a front view showing the first connector housing.
Figure 12:
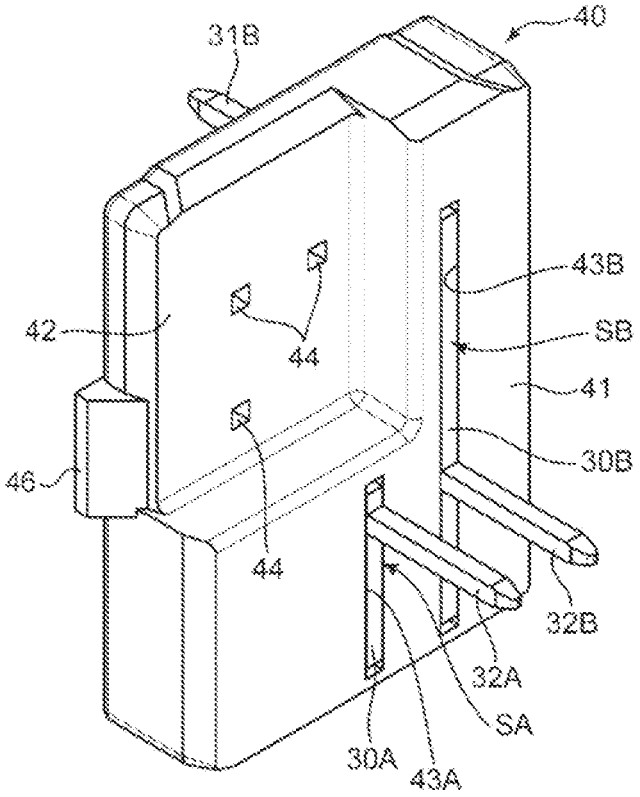
FIG. 12 is a perspective view showing shorting members of the electrical connection device and a shorting member holding member for holding the shorting member.
Figure 13:
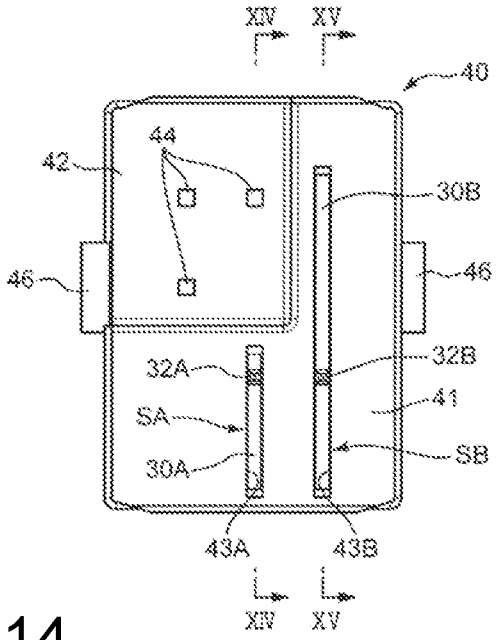
FIG. 13 is a front view showing the shorting members and the shorting member holding member.
Figure 14:
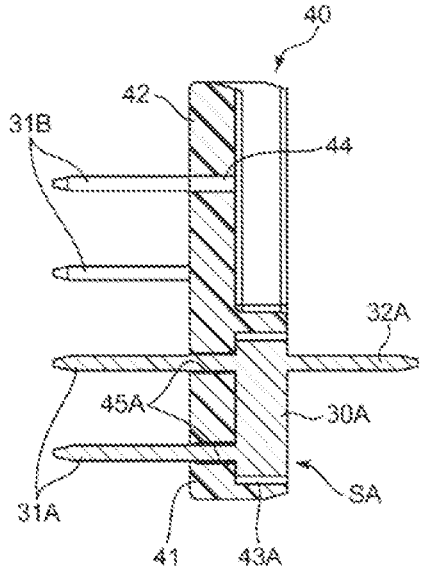
FIG. 14 is a side view in section along XIV-XIV of FIG. 13.
Figure 15:
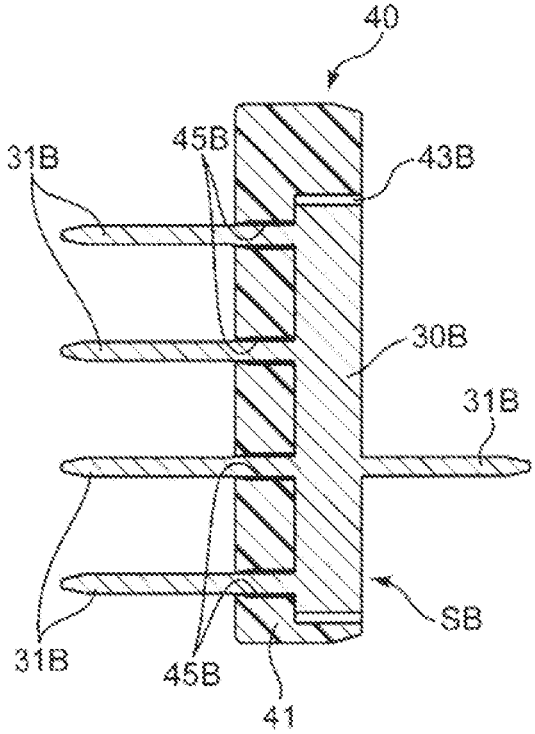
FIG. 15 is a side view in section along XV-XV of FIG. 13.

As also shown in FIGS. 10 and 11, the first connector housing H1 according to this embodiment is divided into plural housing elements 20A, 20B, 20C, 20D and 20E. The respective housing elements 20A to 20E are molded of an insulating material such as synthetic resin and are different from each other. These housing elements 20A to 20E are stacked in a vertical direction perpendicular to the connector connecting direction and are connected to each other, thereby being united to construct the first connector housing H1. Specifically, each of the housing elements 20A to 20E are stacked one on another in this order from bottom. Each of the housing elements 20A to 20D includes two holding pieces 22 hold embrace the housing element 20B to 20E stacked right above.

The first connector housing according to the invention is not limited to such a divided connector housing. The first connector housing may be entirely integrally molded.

Each of the housing elements 20A to 20D includes terminal accommodation chambers 24 having the same shape. The terminal accommodation chambers 24 in each housing element 20A to 20D are arranged in a direction perpendicular to the connector connecting direction and perpendicular to a stacking direction of the housing elements 20A to 20E (hereinafter, referred to as a "connector horizontal direction"). Each terminal accommodation chamber 24 includes a terminal insertion opening 24*a* open in an end part of the first connector housing H1 opposite to the second connector C2 and receives the first shorting female terminal TS1 or mutual connection female terminal TM1 inserted along the connector connecting direction through this terminal insertion opening 24*a*.

Each housing element 20A to 20D is formed with unillustrated terminal locking portions (locking lances) corresponding to the respective terminal accommodation chambers 24. Each terminal locking portion has a function of engaging and holding the female terminal TM1 or TS1 inserted into the corresponding terminal accommodation chamber 24. A position where the terminal TS1, TM1 is held in each terminal accommodation chamber 24 is set at such a position that all of the electrical contact portions 10 of the respective terminals TS1, TM1 are arranged in terminal arrangement directions (connector vertical direction and connector horizontal direction) perpendicular to the connector connecting direction in the front end part of the first connector housing H1 near the second connector housing C2.

The first connector housing H1 includes more terminal accommodation chambers 24 (a total of twelve in this embodiment) than a total number (nine in this embodiment) of the first shorting female terminals TS1 and the mutual connection female terminals TM1. Some of these terminal accommodation chambers 24 are selected and the female terminal TS1 or TM1 is inserted into each of the selected terminal accommodation chambers 14.

Each of the housing elements 20B, 20C, 20D and 20E excluding the lowermost housing element 20A is formed with a secondary locking projection 26B, 26C, 26D or 26E projecting down from the bottom surface of the housing element. On the other hand, each of the housing elements 20A, 20B, 20C and 20D excluding the uppermost housing element 20E is formed with a projection insertion opening 27 for receiving the secondary locking projection 26B to 26E of the housing element 20B to 20E located right above inserted from above when the housing elements 20A to 20E are united. Each secondary locking projection 26B to 26E is inserted into the housing element 20A to 20D through the projection insertion opening 27, thereby engaging suitable parts of the female terminals TS1 or TM1 accommodated in the terminal accommodation chambers 24 of the housing element 20A to 20D to secondarily lock (locking in addition to locking by the locking lances) the female terminals TS1 or TM1.

The secondary locking is not essential in the present invention. For example, the respective terminals may be held only by the secondary locking projection 26B to 26E by omitting the locking lances. In short, a specific holding mode of the terminals in the first connector housing is not limited in the present invention.

The uppermost housing element 20E is formed with a locked piece 28. The locked piece 28 is resiliently deflectable and deformable downwardly and the first and second connectors C1, C2 are locked in a connected state, as described later utilizing this locked piece 28.

The second connector C2 includes second shorting female terminals TS2, mutual connection male terminals TM2, a first shorting member SA, a second shorting member SB and a second connector housing H2.

The second shorting female terminals TS2 are mounted respectively on ends of shorting target wires (two shorting target wires in this embodiment; hereinafter, referred to as "second shorting target wires") WS2 excluding the first shorting target wires WS1. Similarly, the mutual connection male terminal TM2 is mounted on an end of the other wire WM2 of each pair of mutual connection target wires three mutual connection target wires; hereinafter, referred to as "second mutual connection target wires").

Each terminal TS2, TM2 is made of a conductive material similarly to each female terminal TS1, TM1 of the first connector C1. Each second shorting female terminal TS2 has the same shape as the first shorting female terminals TS1, i.e. is shaped to include a female electrical contact portion 10 and a crimping portion 12 located integrally behind the electrical contact portion 10. On the other hand, each mutual connection male terminal TM2 integrally includes a male electrical contact portion 10 and a crimping portion 12 located behind the male electrical contact portion 11. The male electrical contact portion 11 is shaped to be fit in close contact with the female electrical contact portion 10 of the mutual connection female terminal TM1. The electrical contact portions 10, 11 enable electrical connection between the mutual connection female terminal TM1 and the mutual connection male terminal TM2 by being connected to each other.

Similarly to each terminal TS1, TM1 of the first connector C1, each of the crimping portions 12 of the second shorting female terminals TS2 and the mutual connection male terminals TM2 includes a barrel to be crimped to embrace an exposed conductor part and an insulation coating part behind the exposed conductor part at the end of each wire WS2, WM2 and enables electrical connection between the conductor part and the female terminal TS2 or the male terminal TM2 by being crimped to the conductor part.

The first and second shorting members SA, SB are made of a conductor (metal plate) and form a shorting circuit for shorting together female terminals TS1, TS2 selected from a female terminal group composed of the first shorting female terminals TS1 and the of second shorting female terminals TS2.

Specifically, as also shown in FIGS. 12 to 15, the first shorting member SA integrally includes a single base 30A, plural first male terminals 31A (two in this embodiment) and one second male terminal 31A. Similarly, the second shorting member SB integrally includes a single base 30B, plural second male terminals 31B (four in this embodiment) and (one in this embodiment) second male terminal 32B. As also described later, these first and second shorting members SA, SB are held in the second connector housing H2 to be arranged in the connector horizontal direction in an upright posture.

Each base 30A, 30B of the first and second shorting members SA, SB is in the form of a rectangular plate extending in the vertical direction in this embodiment. Each of the first male terminals 31A, 31B projects from the base 30A, 30B in a first projecting direction (left in FIGS. 4 to 6) toward the first connector C1 and is shaped to fit to the female electrical contact portion 10 of the first shorting female terminal TS1. Similarly, each of the second male terminals 32A, 32B projects from the base 30A, 30B in a second projecting direction opposite to the first projecting direction and is shaped to fit to the female electrical contact portion 10 of the second shorting female terminal TS2.

By the above configuration, the first shorting member SA forms a shorting circuit for shorting the respective first shorting female terminals TS1 to be connected to the respective first male terminals 31A and the second shorting female terminal TS2 to be connected to the second male terminal portion 32A to each other. Similarly, the second shorting member SB forms a shorting circuit for shorting the respective first shorting female terminals TS1 to be connected to the respective first male terminals 31B and the second shorting female terminal TS2 to be connected to the second male terminal 32B to each other.

The second connector housing H2 includes a shorting member holder 40 and a housing body 50. The shorting member holder 40 and the housing body 50 are molded of an insulating material, such as synthetic resin, as members different from each other. The shorting member holder 40 locates the first and second shorting members SA, SB in predetermined postures at predetermined positions of the second connector housing H2 by being mounted into the housing body 50 while holding the first and second shorting members SA, SB. The housing body 50 includes a receptacle 51 and a terminal holding portion 52. The receptacle 51 is a housing fitting portion shaped such that the first connector housing H1 can fit therein, and a locking projection 58 for locking the first and second connector housings H1, H2 in a connected state by being engaged with the locked piece 28 of the connector housing H1 is formed on an end part of the receptacle 51. The terminal holding portion 52 is connected to the receptacle 51 in a direction parallel to the connector connecting direction and holds the second shorting female terminals TS2 and the mutual connection male terminals TM2.

As shown in FIGS. 12 to 15, the shorting member holder 40 is substantially in the form of a rectangular plate and integrally includes a shorting member holding portion 41 and a male terminal insertion allowing portion 42.

The shorting member holding portion 41 includes a first base press-fit groove 43A and a second base press-fit groove 43B, male terminal portion insertion holes 45A (two in this embodiment) connected to the first base press-fit groove 43A and male terminal insertion holes 45B (four in this embodiment) connected to the second shorting member press-fit groove 43B.

The first base press-fit groove 43A is shaped such that the base 30A of the first shorting member SA can be press-fit therein and is long and narrow in the vertical direction. The male terminal portion insertion holes 45A are shaped to allow the respective first male terminals 31A of the first shorting member SA to be inserted therein and project from the shorting member holding portion 41 as the base 30A of the first shorting member SA is press-fit into the first base press-fit groove 43A. In this way, the shorting member holding portion 41 holds the first shorting member SA such that the base 30A of the first shorting member SA extends in the vertical direction and the plurality of first male terminals 31A are arranged in the vertical direction.

The second base portion press-fit groove 43B is adjacent to the first base press-fit groove 43A in the connector horizontal direction (lateral direction in FIG. 13) and is shaped such that the base 30B of the second shorting member SB can be press-fit therein and is long and narrow in the vertical direction. The male terminal insertion holes 45B are shaped to allow the respective first male terminals 31B of the second shorting member SB to be inserted therein and project from the shorting member holding portion 41 as the base 30B of the second shorting member SB is press-fit into the second base portion press-fit groove 43B. In this way, the shorting member holding portion 41 holds the second shorting member SB such that the base 30B of the second shorting member SB extends in the vertical direction and the first male terminals 31B are arranged in the vertical direction.

The male terminal insertion allowing portion 42 is at a position deviated from the shorting member holder 41 in a direction perpendicular to the connector connecting direction and is shaped to allow the insertion of the male electrical contact portions 11 of the mutual connection male terminals TM2 despite the presence of the shorting member holder 40. Specifically, the male terminal insertion allowing portion 42 is thinner than the shorting member holding portion 41 and includes male terminal insertion holes 44 penetrating therethrough in a thickness direction. Each male terminal insertion hole 44 is shaped to allow the insertion of the electrical contact portion 11 of the mutual connection male terminal TM2.

Figure 1:
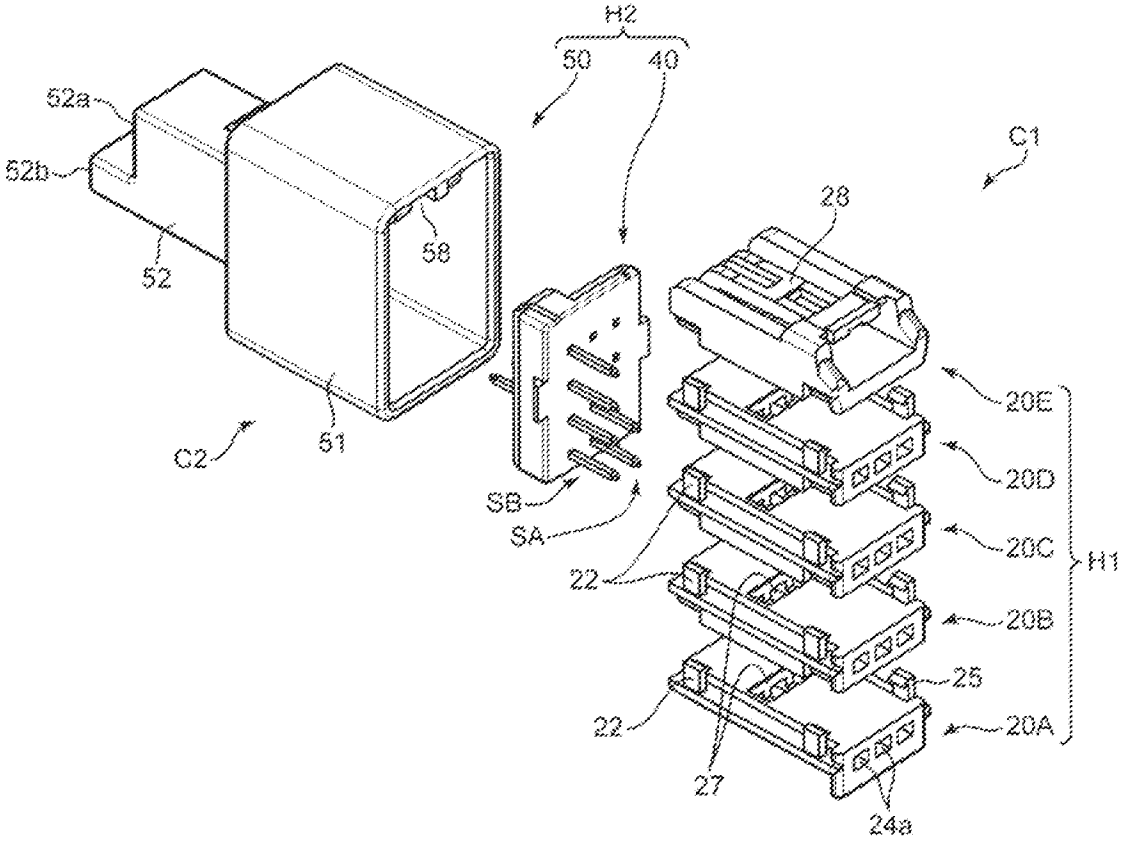
FIG. 1 is an exploded perspective view of a complex electrical connection device according to an embodiment of the present invention.
Figure 2:
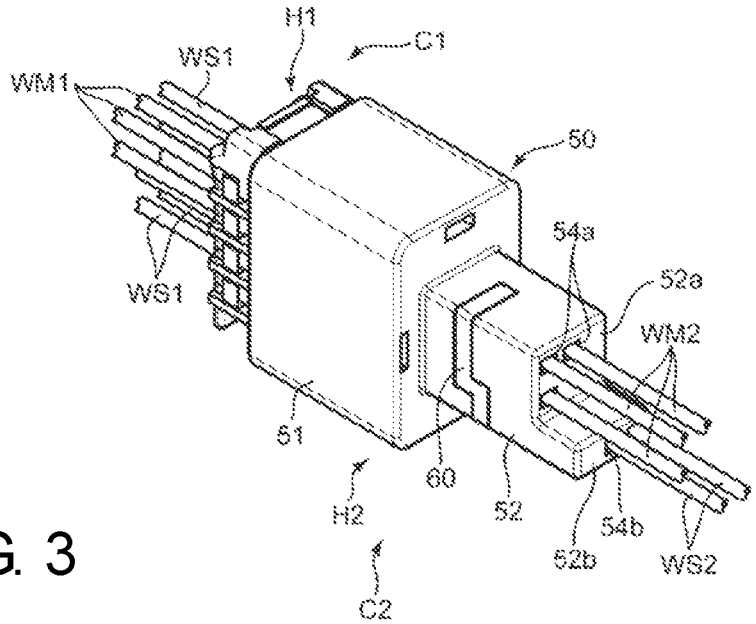
FIG. 2 is an assembled perspective view of the electrical connection device.
Figure 3:
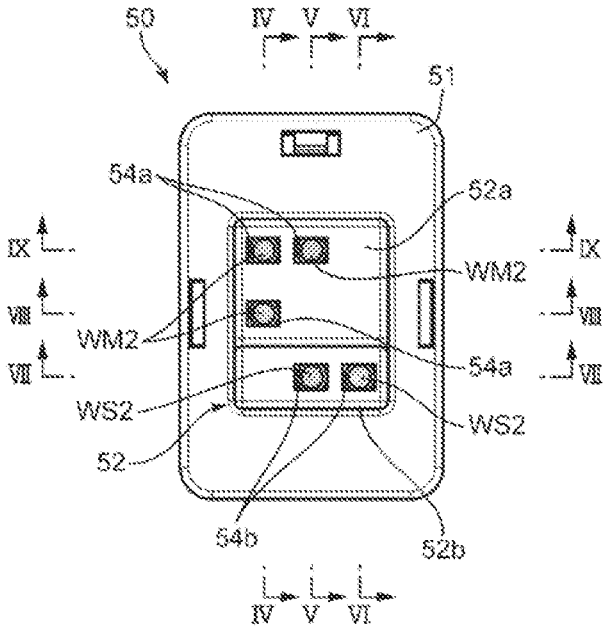
FIG. 3 is a front view partly in section of the electrical connection device viewed from the side of a second connector.
Figure 4:
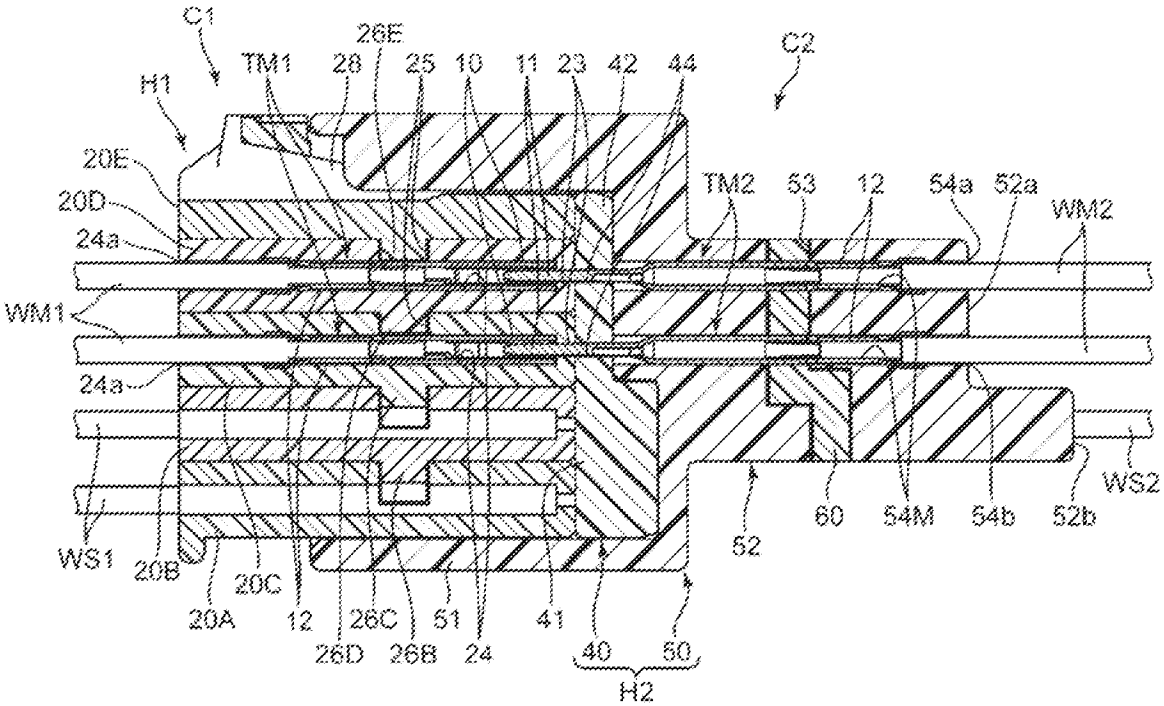
FIG. 4 is a side view in section along IV-IV of FIG. 3.
Figure 5:
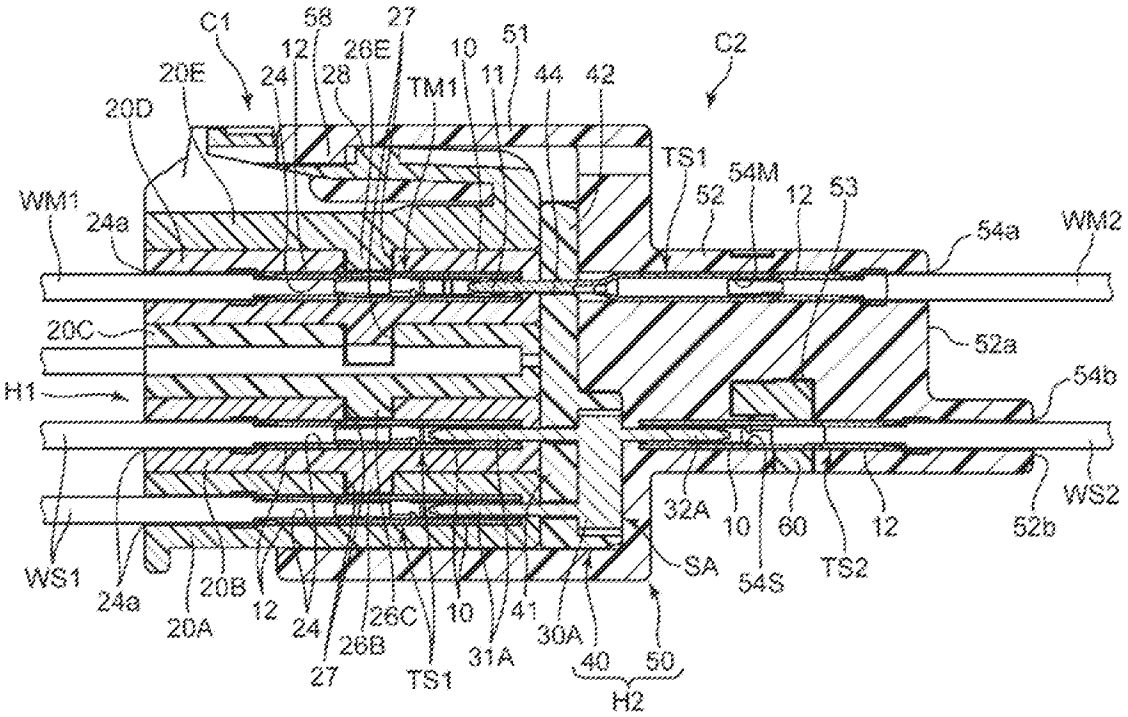
FIG. 5 is a side view in section along V-V of FIG. 3.
Figure 6:
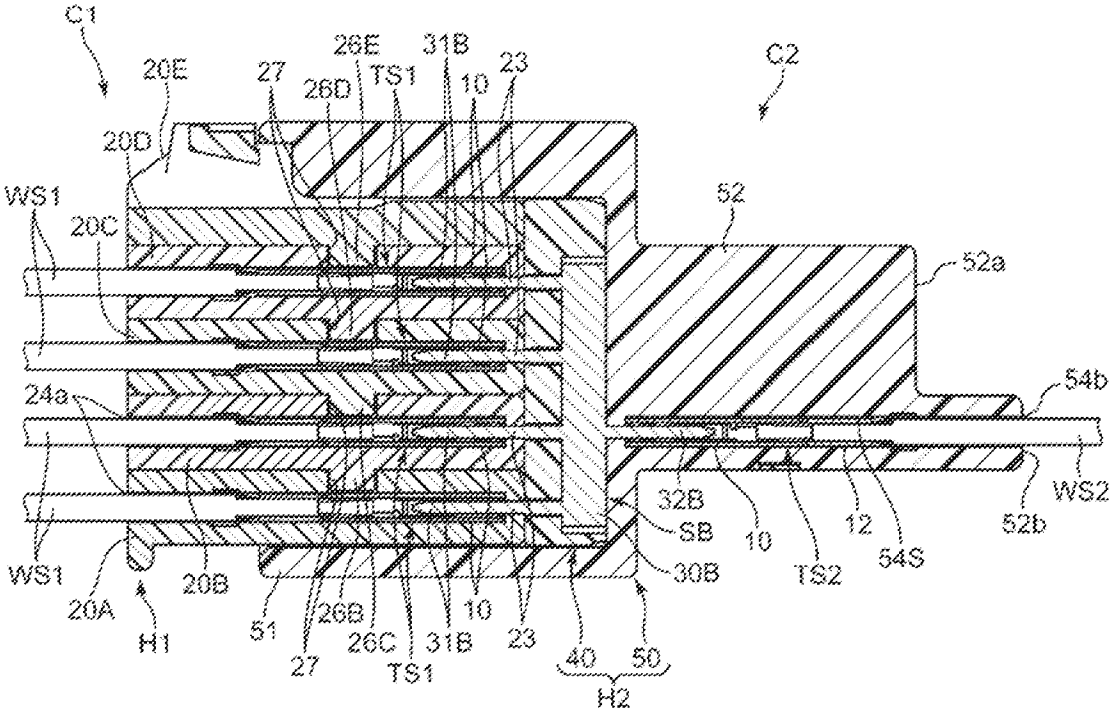
FIG. 6 is a side view in section along VI-VI of FIG. 3.
Figure 7:
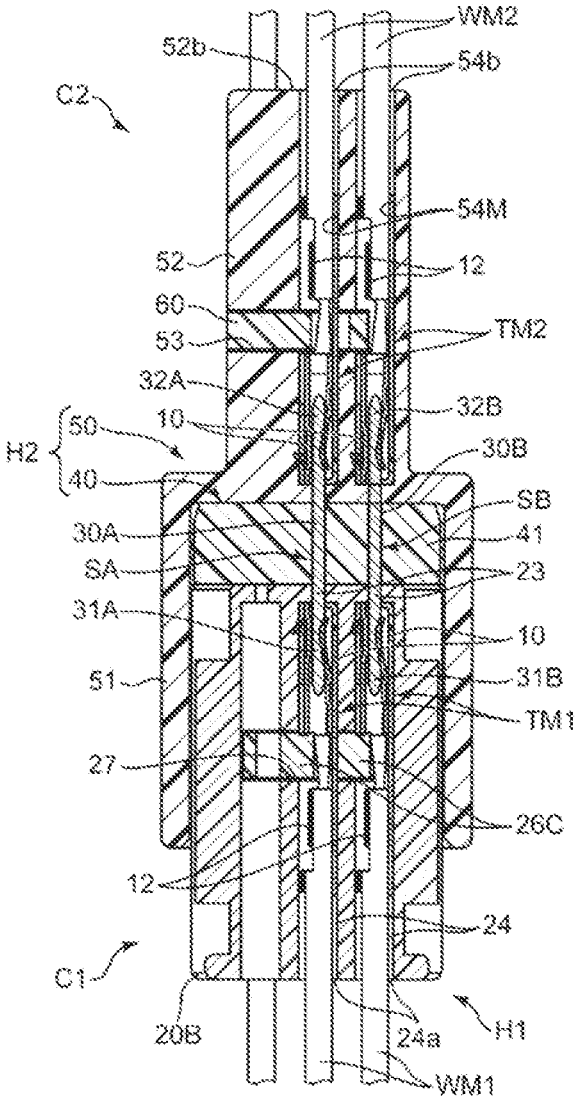
FIG. 7 is a bottom view in section along VII-VII of FIG. 3.
Figure 8:
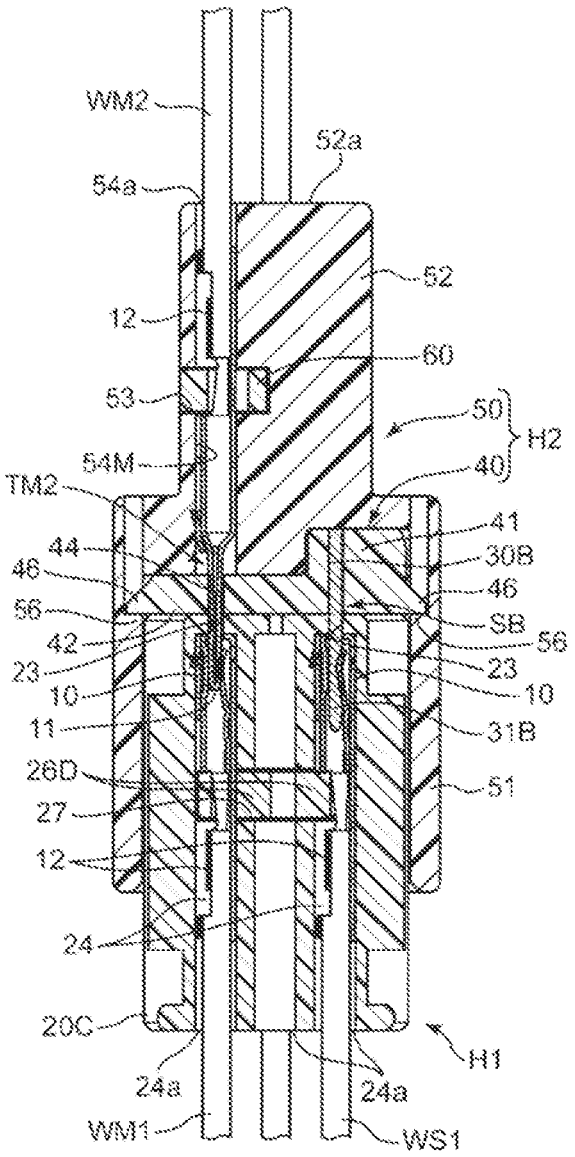
FIG. 8 is a bottom view in section along VIII-VIII of FIG. 3.
Figure 9:
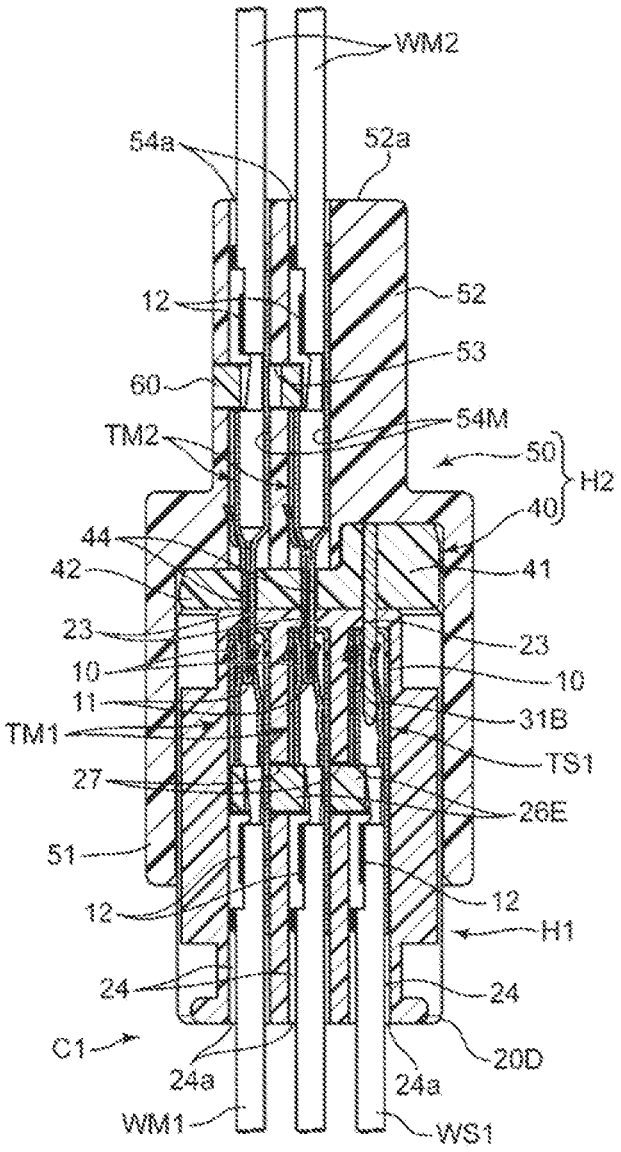
FIG. 9 is a bottom view in section along IV-IV of FIG. 3.

The shorting member holder 41 includes two locked projections 46 projecting laterally out and the locked projections 46 are locked to steps 56 formed on a back end side of the receptacle 51 of the housing body 50, as shown in FIG. 8. In this way, the shorting member holder 41 is fixed in the housing body 50.

By being mounted into the housing body 50 while holding the first and second shorting members SA, SB in this way, the shorting member holder 41 positions the first and second shorting members SA, SB such that the first male terminals 31A, 31B of the first and second shorting members SA, SB project into the receptacle 51 and are aligned perpendicular to the connector connecting direction in the receptacle 51. The first and second shorting members SA, SB are set at such positions that the electrical contact portions 10 of the respective first shorting female terminals TS1 held in the first connector housing H1 and the first male terminal portions 31A, 32B of the first and second shorting members SA, SB are connected respectively to each other as the first connector housing H1 is fit to a proper position (position where the locked piece 28 of the first connector housing H1 is locked to the locking projection 58 on the end part of the receptacle 51) into the receptacle 51.

The terminal holding portion 52 functions as a male terminal holding portion for holding the respective mutual connection male terminals TM2 and a female terminal holding portion for holding the respective second shorting female terminals TS2. Specifically, the terminal holding portion 52 is substantially in the form of a rectangular parallelepiped extending rearward (toward a side opposite to the first connector C1) from the receptacle 51 and includes male terminal accommodation chambers 54M for accommodating the mutual connection male terminals TM2 and female terminal accommodation chambers 54S for accommodating the second shorting female terminals TS2. Each male terminal accommodation chamber 54M accommodates the mutual connection male terminal TM2 at a position where the mutual connection male terminal TM2 can be inserted into the male terminal insertion hole 44 of the shorting member holding member 40 from the side opposite to the receptacle 51 and projects into the receptacle 51. Each female terminal accommodation chamber 54S accommodates the second shorting female terminal TS2 at a position where the electrical contact portion 10 of the second shorting female terminal TS2 can be connected to the second male terminal portion 32A, 32B of the first or second shorting member SA, SB.

Each of the male terminal accommodation chambers 54M and the female terminal accommodation chambers 54S includes a male terminal insertion opening 54*a* or a female terminal insertion opening 54*b* in an end part of the entire second connector housing H2 opposite to the receptacle 51 (hereinafter, referred to as a rear end part of the second connector housing H2 or a rear end part of the terminal holding portion 52) and receives the mutual connection male terminal TM2 or the second shorting female terminal TS2 inserted in a terminal inserting direction parallel to the connector connecting direction through the terminal insertion opening 54*a*, 54*b*.

Similar to the first connector housing H1, the terminal holding portion 52 is formed with unillustrated terminal locking portions (locking lances) corresponding to the respective terminal accommodation chambers 54M, 54S. Each terminal locking portion has a function of engaging and holding the terminal TM2 or TS2 inserted into the corresponding terminal accommodation chamber 54M, 54S. A position where the mutual connection male terminal TM2 is held in each male terminal accommodation chamber 54M is set such that the electrical contact portion 11 of the male terminal TM2 is inserted into the male terminal insertion hole 44 of the shorting member holder 40, projects into the receptacle 51 and is aligned with the first male terminals 31A, 31B of the first and second shorting member SA, SB in the terminal arrangement directions (connector vertical direction and connector horizontal direction) perpendicular to the connector connecting direction. This position is, in other words, a position where the electrical contact portion 11 of the mutual connection male terminal TM2 is fit to the electrical contact portion 10 of the mutual connection female terminal TM1 held in the first connector housing H1 as the first connector housing H1 is fit into the receptacle 51. On the other hand, a position where the second shorting female terminal TS2 is held in each female terminal accommodation chamber 54S is set such that the electrical contact portion 10 of the second shorting female terminal TS2 is fit to the second male terminal 32A, 32B of the first or second shorting members SA, SB.

Terminal insertion openings 23 are formed in a front end wall of the first connector housing H1. These terminal insertion openings 23 respectively allow the insertion of the first male terminals 31A, 31B and the electrical contact portions 11 of the mutual connection male terminals TM2 and enable the first male terminals 31A, 31B and the electrical contact portions 11 to be fit to the electrical contact portions 10 of the first shorting female terminals TS1 and the mutual connection female terminals TM1.

In this embodiment, the rear end surface of the second connector housing H2 includes a step, as shown in FIGS. 1 to 6. This step is formed between an end surface (lower rear end surface in this embodiment) 52*b* enclosing the female terminal insertion openings 54*b* and an end surface (upper rear end surface in this embodiment) 52*a* enclosing the male terminal insertion openings 54*a* in the rear end part of the second connector housing H2 so that the female terminal insertion openings 54*b* are located behind the male terminal insertion openings 54*a* in the terminal inserting direction. This step is set to correspond to a positional deviation in the connector connecting direction between the mutual connection male terminals TM2 to be directly connected to the mutual connection female terminals TM1 and the second shorting female terminals TS2 to be connected to the first shorting female terminals TS1 via the shorting members SA, SB.

A retainer 60 for secondarily locking (locking in addition to locking by the locking lances) the second shorting female terminals TS2 and the mutual connection male terminals TM2 is mounted into the second connector housing H2 according to this embodiment. Specifically, the second connector housing H2 is formed with a retainer mounting groove 53 having a suitable shape traversing in a direction perpendicular to the connector connecting direction, and the retainer 60 is fit into this retainer mounting groove 53. The retainer 60 is fit into the retainer mounting groove 53 to be movable in the connector horizontal direction between a position where the insertion of each terminal TM2, TS2 into each terminal accommodation chamber 54M, 54S is allowed and a position where the terminals TM2, TS2 completely inserted into the terminal accommodation chambers 54M, 54S are locked secondarily, as shown in FIGS. 4 to 9. Further, the shapes of the retainer mounting groove 53 and the retainer 60 are stepped to correspond to the positional deviation in the connector connecting direction between the mutual connection male terminals TM2 and the second shorting female terminals TS2 as described above.

Secondary locking by the retainer 60 is not essential in the present invention. For example, the respective terminals may be held only by the retainer 60 by omitting the locking lances. In short, a specific holding mode of the terminals in the second connector housing is not limited in the present invention.

According to the electrical connection device described above, it is possible to simultaneously and efficiently short the shorting target wires WS1, WS2 to each other and mutually connect the first and second mutual connection target wires WM1, WM2 one-to-one in the following manner.

1) Mounting of Each Terminal on Each Wire

Each first shorting female terminal TS1 is mounted on the end of each first shorting target wire WS1, and each mutual connection female terminal TM1 is mounted on the end of the first mutual connection target wire WM1. Further, each second shorting female terminal TS2 is mounted on the end of each second shorting target wire WS2, and each mutual connection male terminal TM2 is mounted on the end of the second mutual connection target wire WM2.

2) Holding of Each Terminal by Each Housing and Construction of First Connector Housing In the first connector C1, suitable terminal accommodation chambers 24 are selected out of the plural terminal accommodation chambers 24 formed in the respective housing elements 20A to 20D, and the first shorting female terminals TS1 and the mutual connection female terminals TM1 are inserted respectively into the selected terminal accommodation chambers 24 through the terminal insertion openings 24*a* and held. Further, the housing elements 20A to 20E are stacked one on another to be united, thereby constructing the first connector housing H1. The terminal accommodation chambers 24 are selected such that the first shorting female terminals TS1 and the mutual connection female terminals TM1 held in the selected terminal accommodation chambers 24 are respectively connectable to the first male terminals 31A, 31B of the first and second shorting members SA, SB and the mutual connection male terminals TM2 of the second connector C2 when the first and second connector housings H1, H2 are connected to each other as described later.

Each terminal TS1, TM1 may be inserted after the housing elements 20A to 20E are united. It goes without saying that the uniting operation is unnecessary if the entire first connector housing H1 is formed integrally.

In the second connector C2, the shorting member holder 40 is mounted at a predetermined boundary position between the receptacle 51 and the terminal holding portion 52 in the housing body 50. Thus the first and second shorting members SA, SB are set in the second connector housing H2. Then, each mutual connection male terminal TM2 is inserted into each male terminal accommodation chamber 54M in the terminal inserting direction through the male terminal insertion opening 54*a* and held. Additionally, each second shorting female terminal TS2 is inserted into each female terminal accommodation chamber 54S in the terminal inserting direction through the female terminal insertion opening 54*b* and held.

The insertion of each mutual connection male terminal TM2 into each male terminal accommodation chamber 54M is accompanied by the insertion of the electrical contact portion 11 of the mutual connection male terminal TM2 into the male terminal insertion hole 42 of the shorting member holder 40. This insertion enables the electrical contact portions 11 to project into the receptacle 51 and to be aligned in the terminal arrangement directions perpendicular to the connector connecting direction together with the first male terminals 31A, 31B of the first and second shorting members SA, SB. On the other hand, the insertion of the second shorting female terminals TS2 into the respective female terminal accommodation chambers 54S enables the electrical contact portions 10 of the second shorting female terminals TS2 to be connected respectively to the second male terminals 32A, 32B of the first and second shorting members SA, SB to connect the first and second shorting members SA, SB electrically to each other.

The step provided between the upper rear end surface 52*a* enclosing each male terminal insertion opening 54*a* and the lower rear end surface 52*b* enclosing each female terminal insertion opening 54*b* in the rear end surface of the terminal holding portion 52 makes the female terminal accommodation chambers 54S and the male terminal accommodation chambers 54M easily distinguishable, thereby preventing erroneous insertion between the second shorting female terminals TS2 and the mutual connection male terminals TM2. The step also makes an insertion depth of the second shorting female terminals TS2 into the female terminal accommodation chambers 54S and an insertion depth of the mutual connection male terminals TM2 into the male terminal accommodation chambers 54M equal.

Specifically, the electrical contact portion 11 of the mutual connection male terminal TM2 is connected directly to the electrical contact portion of the mutual connection female terminal TM1, whereas the electrical contact portion 10 of the second shorting female terminal TS2 is connected to the second male terminal 32A or 32B of the shorting member SA or SB interposed between this electrical contact portion 10 and the electrical contact portion 10 of the first shorting female terminal TS1. Thus, if the first shorting female terminal TS1 and the electrical contact portion 10 of the mutual connection female terminal TM1 are aligned in the terminal arrangement directions, there is a deviation in the terminal inserting direction between the position where the electrical contact portion 11 of the mutual connection male terminal TM2 is fit to the electrical contact portion 10 of the mutual connection female terminal TM1 and the position where the electrical contact portion of the second shorting female terminal TS2 is fit to the second male terminal 32A or 32B of the shorting member SA or SB. However, the step provided between the upper rear end surface 52*a* and the lower rear end surface 52*b* reduces a difference between the insertion depth of the second shorting female terminals TS2 into the female terminal accommodation chambers 54S and the insertion depth of the mutual connection male terminals TM2 into the male terminal accommodation chambers 54M by absorbing the deviation. Thus, a sense of incongruity of a worker can be reduced by making an inserting operation of each terminal uniform.

Particularly, the step provided between the upper rear end surface 52*a* and the lower rear end surface 52*b* according to this embodiment has a size equivalent to the deviation in the terminal inserting direction between the position where the electrical contact portions 10 of the mutual connection female terminals TM1 are fit to the electrical contact portions 11 of the mutual connection male terminals TM2 and the position where the electrical contact portions 10 of the second shorting female terminals TS2 are fit to the second male terminal portions 32A, 32B of the first and second shorting members SA, SB. This enables the sense of incongruity of the worker to be reduced further by making the insertion depth of the second shorting female terminals TS2 into the female terminal accommodation chambers 54S and the insertion depth of the mutual connection male terminals TM2 into the male terminal accommodation chambers 54M equal.

3) Connection of Connectors

By connecting the first connector C1 and the second connector C2 to each other with the respective terminals held in the respective connector housings H1, H2 as described above, all of the necessary electrical connections are achieved collectively and simultaneously. Specifically, as the first connector housing H1 is fit into the receptacle 51 of the second connector housing H2, the electrical contact portions 10 of the first shorting female terminals TS1 of the first connector C1 are fit to the first male terminals 31A, 31B of the first and second shorting members SA, SB of the second connector C2 to form the shorting circuit for shorting all the shorting female terminals including the first shorting female terminals TS1 and the second shorting female terminals TS2 to each other. On the other hand, the electrical contact portions 10 of the mutual connection female terminals TM1 of the first connector C1 are fit directly to the corresponding electrical contact portions 11 of the mutual connection male terminals TM2 of the second connector C2, whereby the both terminals TM1, TM2 can be mutually connected one-to-one.

As described above, according to the electrical connection device relating to this embodiment, it is possible to simultaneously realize the formation of the shorting circuit for shorting all the shorting target wires WS1, WS2 to each other and mutual one-to-one connection of the mutual connection target wires WM1, WM2 merely by a simple operation of connecting the first connector C1 and the second connector C2 to each other and by a compact structure not requiring a plurality of types of devices.

The invention is not limited to the embodiment described above.

For example, the total number of the shorting members included in the second connector according to the present invention is not limited. The second connector may include only one shorting member or additionally include third and fourth shorting members.

The shorting member holding portion according to the present invention may be also integrally formed to the housing fitting portion and the terminal holding portion. However, it facilitates the arrangement of shorting members to mold the shorting member holding member as a member different from the housing body as in the above embodiment if the second connector includes the plural shorting members. Further, the shorting member holder includes the male terminal insertion allowing portion in addition to the terminal holding portion, allows the insertion of the mutual connection male terminals at positions deviated from the shorting members in the direction perpendicular to the connector connecting direction and enables the mutual connection male terminals to be aligned with the first male terminal portions of the shorting members in the directions perpendicular to the connector connecting direction. This enables the mutual connection male terminals to be connected to the mutual connection female terminals despite the presence of the shorting member holding member. This effect can be obtained not only when the shorting member holding member includes the male terminal insertion holes 44 according to the above embodiment, but also when the shorting member holding member has such an outer shape avoiding an area where the mutual connection male terminals are present.

As described above, a complex electrical connection device is provided to enable both the shorting of three or more wires to each other and mutual one-to-one connection of specific wires by a compact structure and an efficient operation.

Provided is a complex electrical connection device having both a function of shorting three or more shorting target wires to each other and a mutually connecting function of mutually connecting mutual connection target wires different from the shorting target wires one-to-one. This device includes a first connector and a second connector connectable to the first connector in a specific connector connecting direction. The first connector includes first shorting female terminals having female electrical contact portions and to be mounted on ends of some of the plurality of shorting target wires, mutual connection female terminals having female electrical contact portions and to be mounted on an end of one of each pair of the mutual connection target wires, and a first connector housing configured to hold the first shorting female terminals and the mutual connection female terminals in such an orientation that all the electrical contact portions of the first shorting female terminals and the mutual connection female terminals face in the same direction. The second connector includes second shorting female terminals having female electrical contact portions and to be mounted on ends of the wires other than those, on which the first shorting female terminals are to be mounted, out of the plurality of shorting target wires, mutual connection male terminals having male electrical contact portions that can fit to the electrical contact portions of the mutual connection female terminals and to be mounted on an end of the other of each pair of the mutual connection target wires, a shorting member made of a conductor and configured to short a plurality of female terminals including the first shorting female terminals and the second shorting female terminals, the shorting member integrally including a base portion, first male terminal portions projecting in a first projecting direction from the base portion and shaped to fit to the electrical contact portions of the first shorting female terminals and second male terminal portions projecting from the base portion in a second projecting direction opposite to the first projecting direction and shaped to fit to the electrical contact portions of the second shorting female terminals, the shorting member forming a shorting circuit configured to short the first shorting female terminals to be connected to the first male terminals and the second shorting female terminals to be connected to the second male terminals to each other, and a second connector housing connectable to the first connector housing in the connector connecting direction. The second connector housing includes a housing fitting portion to be fit to the first connector housing, a shorting member holding portion configured to hold the shorting member at a position where the first shorting female terminals held in the first connector housing are connected to the first male terminal portions as the first connector housing is fit to the housing fitting portion, a male terminal holding portion configured to hold the mutual connection male terminals at positions which are deviated from the shorting member in a direction perpendicular to the connector connecting direction and where the mutual connection female terminals held in the first connector housing are connected to the mutual connection male terminals as the first connector housing is fit to the housing fitting portion, and a female terminal holding portion configured to hold the second shorting female terminals at positions where the second shorting female terminals are connected to the second male terminals.

In this complex electrical connection device, it is possible to collectively and simultaneously short the female terminals including the first shorting female terminals and the second shorting female terminals to each other by fitting the electrical contact portions of the first shorting female terminals in the first connector and the first male terminal portions of the shorting member and mutually connect the mutual connection female terminals and the mutual connection male terminals by fitting the electrical contact portions of the mutual connection female terminals in the first connector and the electrical contact portions of the mutual connection male terminals in the second connector by a simple operation of only fitting the first connector housing of the first connector to the housing fitting portion of the second connector housing with the second shorting female terminals and the mutual connection male terminals of the second connector respectively held in the second shorting female terminal holding portion and the mutual connection male terminal holding portion of the second connector (i.e. with the electrical contact portions of the second shorting female terminals fit to the second male terminal portions of the shorting member). That is, the shorting of the shorting target wires to each other and mutual one-to-one connection of the mutual connection target wires can be efficiently performed by a compact structure by fitting the first connector and the second connector in the connector connecting direction.

In this device, preferably, the female terminal holding portion of the second connector housing includes female terminal insertion openings open on a side opposite to the housing fitting portion across the shorting member and female terminal accommodation chambers configured to receive the second shorting female terminals inserted through the female terminal insertion openings in a terminal inserting direction parallel to the connector connecting direction to a position where the second shorting female terminals are connected to the second male terminals, and the male terminal holding portion of the second connector housing includes male terminal insertion openings open on a side opposite to the housing fitting portion across the shorting member and male terminal accommodation chambers configured to receive the mutual connection male terminals inserted in the terminal inserting direction to a position where the mutual connection male terminals are connectable to the mutual connection female terminals. This enables the second shorting female terminals and the mutual connection male terminals to be inserted into the female terminal accommodation chambers and the male terminal accommodation chambers in the same terminal inserting direction from the same side, thereby facilitating an operation of setting the second shorting female terminals and the mutual connection male terminals in the second connector housing.

On the other hand, the first connector housing preferably holds the first shorting female terminals and the mutual connection female terminals such that the electrical contact portions of the first shorting female terminals and the electrical contact portions of the mutual connection female terminals are aligned in a terminal arrangement direction perpendicular to the connector connecting direction, and the shorting member holding portion and the male terminal holding portion of the second connector housing preferably respectively hold the shorting member and the mutual connection male terminals such that the first male terminals of the shorting member and the electrical contact portions of the mutual connection male terminals are aligned in the terminal arrangement direction. The alignment of the respective terminals in the terminal arrangement direction enables the first shorting female terminals and the mutual connection female terminals held in the first connector housing to be collectively connected to the first male terminal portions of the shorting member and the mutual connection male terminals held in the second connector housing without complicating the shape and structure of the first connector housing.

In the device having such an alignment, it is preferable to provide a step in the terminal inserting direction between an end surface enclosing the female terminal insertion openings and an end surface enclosing the male terminal insertion openings in the second connector housing so that the female terminal insertion openings are located behind the male terminal insertion openings in the terminal inserting direction if the female terminal holding portion and the male terminal holding portion respectively include the female terminal accommodation chambers and the male terminal accommodation chambers. This step prevents erroneous insertion of each terminal by making the female terminal accommodation chambers and the male terminal accommodation chambers easily distinguishable and, in addition, makes an insertion depth of the second shorting female terminals into the female terminal accommodation chambers and an insertion depth of the mutual connection male terminals into the male terminal accommodation chambers equal.

Specifically, the electrical contact portions of the mutual connection male terminals are directly connected to the electrical contact portions of the mutual connection female terminals, whereas the electrical contact portions of the second shorting female terminals are fit not to the electrical contact portions of the first shorting female terminals, but to the second male terminal portions of the shorting member interposed between the electrical contact portions. Thus, if the electrical contact portions of the first shorting female terminals and the mutual connection female terminals are aligned in the terminal arrangement direction, there is a deviation in the terminal inserting direction between a position where the electrical contact portions of the mutual connection female terminals are fit to the electrical contact portions of the mutual connection male terminals and a position where the electrical contact portions of the second shorting female terminals are fit to the second male terminal portions of the shorting member. However, the step provided between the end surface enclosing the female terminal insertion openings and the end surface enclosing the male terminal insertion openings as described above reduces a difference between the insertion depth of the second shorting female terminals into the female terminal accommodation chambers and the insertion depth of the mutual connection male terminals into the male terminal accommodation chambers by absorbing the above deviation, whereby a sense of incongruity of a worker can be reduced by making an inserting operation of each terminal uniform.

Particularly, if the step has a size equivalent to the deviation in the terminal inserting direction between the position where the electrical contact portions of the mutual connection female terminals are fit to the electrical contact portions of the mutual connection male terminals and the position where the electrical contact portions of the second shorting female terminals are fit to the second male terminal portions of the shorting member, the sense of incongruity of the worker can be further reduced by making the insertion depth of the second shorting female terminals into the female terminal accommodation chambers and the insertion depth of the mutual connection male terminals into the male terminal accommodation chambers equal.

The second connector may include plural shorting members as the shorting member, e.g. a first shorting member and a second shorting member independent of the first shorting member. In this case, it is preferable in facilitating the arrangement of the first and second shorting members that the second connector housing includes the housing fitting portion, a housing body including the second shorting female terminal holding portion and the mutual connection male terminal holding portion, and a shorting member holder configured different from the housing body and to be mounted into the housing body while holding the first and second shorting members. In this case, the shorting member holding member enables the mutual connection male terminals to be connected to the mutual connection female terminals despite the presence of the shorting member holder by being shaped to allow the insertion of the mutual connection male terminals at positions deviated from the shorting members in a direction perpendicular to the connector connecting direction and enable the mutual connection male terminals to be arranged in the direction perpendicular to the connector connecting direction together with the first male terminals of the shorting members by the insertion. For example, the shorting member holder may include male terminal insertion holes configured to allow the insertion of the mutual connection male terminals or may have such an outer shape avoiding an area where the mutual connection male terminals are present.

The invention claimed is:

1. A complex electrical connection device having both a function of shorting three or more shorting target wires to each other and a mutually connecting function of mutually connecting pairs of mutual connection target wires different from the shorting target wires one-to-one, comprising:

a first connector; and a second connector connectable to the first connector in a specific connector connecting direction;

the first connector including first shorting female terminals having female electrical contact portions and to be mounted on ends of selected ones of the shorting target wires, mutual connection female terminals having female electrical contact portions and to be mounted on an end of a first wire of each the pairs of the mutual connection target wires, and a first connector housing configured to hold the first shorting female terminals and the mutual connection female terminals in such an orientation that all the electrical contact portions of the first shorting female terminals and the mutual connection female terminals face in the same direction;

the second connector including second shorting female terminals having female electrical contact portions and to be mounted on ends of the shorting target wires other than those on which the first shorting female terminals are to be mounted, mutual connection male terminals having male electrical contact portions fittable to the electrical contact portions of the mutual connection female terminals and to be mounted on an end of a second wire of each of the pairs of the mutual connection target wires, a shorting member made of a conductor and configured to short a plurality of female terminals including the first shorting female terminals and the second shorting female terminals, the shorting member integrally including a base, first male terminal portions projecting in a first projecting direction from the base and shaped to fit to the electrical contact portions of the first shorting female terminals and second male terminal portions projecting from the base in a second projecting direction opposite to the first projecting direction and shaped to fit to the electrical contact portions of the second shorting female terminals, the shorting member forming a shorting circuit configured to short the first shorting female terminals to be connected to the first male terminal portions and the second shorting female terminals to be connected to the second male terminal portions to each other, and a second connector housing connectable to the first connector housing in the connector connecting direction;

the second connector housing including a housing fitting portion to be fit to the first connector housing, a shorting member holding portion configured to hold the shorting member at a position where the first shorting female terminals held in the first connector housing are connected to the first male terminal portions as the first connector housing is fit to the housing fitting portion, a male terminal holding portion configured to hold the mutual connection male terminals at positions that are deviated from the shorting member in a direction perpendicular to the connector connecting direction and where the mutual connection female terminals held in the first connector housing are connected to the mutual connection male terminals as the first connector housing is fit to the housing fitting portion, and a female terminal holding portion configured to hold the second shorting female terminals at positions where the second shorting female terminals are connected to the second male terminal portions.

2. The complex electrical connection device of claim 1, wherein:

the female terminal holding portion of the second connector housing includes female terminal insertion openings open on a side opposite to the housing fitting portion across the shorting member and female terminal accommodation chambers configured to receive the second shorting female terminals inserted through the female terminal insertion openings in a terminal inserting direction parallel to the connector connecting direction to a position where the second shorting female terminals are connected to the second male terminal portions; and the male terminal holding portion of the second connector housing includes male terminal insertion openings open on a side opposite to the housing fitting portion across the shorting member and male terminal accommodation chambers configured to receive the mutual connection male terminals inserted in the terminal inserting direction to a position where the mutual connection male terminals are connectable to the mutual connection female terminals.

3. The complex electrical connection device of claim 1, wherein:

the first connector housing holds the first shorting female terminals and the mutual connection female terminals such that the electrical contact portions of the first shorting female terminals and the electrical contact portions of the mutual connection female terminals are aligned in a terminal arrangement direction perpendicular to the connector connecting direction; and the shorting member holding portion and the male terminal holding portion of the second connector housing respectively hold the shorting member and the mutual connection male terminals such that the first male terminal portions of the shorting member and the electrical contact portions of the mutual connection male terminals are aligned in the terminal arrangement direction.

4. The complex electrical connection device of claim 3, wherein:

the female terminal holding portion of the second connector housing includes female terminal insertion openings open on a side opposite to the housing fitting portion across the shorting member and female terminal accommodation chambers configured to receive the second shorting female terminals inserted through the female terminal insertion openings in a terminal inserting direction parallel to the connector connecting direction to a position where the second shorting female terminals are connected to the second male terminal portions;

the male terminal holding portion of the second connector housing includes male terminal insertion openings open on a side opposite to the housing fitting portion across the shorting member and male terminal accommodation chambers configured to receive the mutual connection male terminals inserted in the terminal inserting direction to a position where the mutual connection male terminals are connectable to the mutual connection female terminals; and a step is provided in the terminal inserting direction between an end surface enclosing the female terminal insertion openings and an end surface enclosing the male terminal insertion openings in the second connector housing so that the female terminal insertion openings are located behind the male terminal insertion openings in the terminal inserting direction.

5. The complex electrical connection device of claim 4, wherein:

the step has a size equivalent to a deviation in the terminal inserting direction between a position where the electrical contact portions of the mutual connection female terminals are fit to the electrical contact portions of the mutual connection male terminals and a position where the electrical contact portions of the second shorting female terminals are fit to the second male terminal portions of the shorting member.

6. A complex electrical connection device according to claim 1, wherein:

the second connector includes a first shorting member and a second shorting member independent of the first shorting member as the shorting member;

the second connector housing includes the housing fitting portion, a housing body including the second shorting female terminal holding portion and the mutual connection male terminal holding portion, and a shorting member hold configured as a member different from the housing body and to be mounted into the housing body while holding the first and second shorting members; and the shorting member hold is shaped to allow the insertion of the mutual connection male terminals at positions deviated from the shorting members in a direction perpendicular to the connector connecting direction and enable the mutual connection male terminals to be arranged in the direction perpendicular to the connector connecting direction together with the first male terminal portions of the shorting members by the insertion.

* * * * *